US009415611B2

(12) United States Patent
Tsirline et al.

(10) Patent No.: US 9,415,611 B2
(45) Date of Patent: Aug. 16, 2016

(54) PLATEN INCORPORATING AN RFID COUPLING DEVICE

(75) Inventors: Boris Tsirline, Glenview, IL (US); Steven R. Kovanko, Downers Grove, IL (US); Tom Zwier, Lake Zurich, IL (US); Karl Torchalski, Arlington Heights, IL (US)

(73) Assignee: ZIH Corp., Lincolnshire, IL (US)

( * ) Notice: Subject to any disclaimer, the term of this patent is extended or adjusted under 35 U.S.C. 154(b) by 1476 days.

(21) Appl. No.: 11/960,136

(22) Filed: Dec. 19, 2007

(65) Prior Publication Data

US 2009/0162123 A1 Jun. 25, 2009

(51) Int. Cl.

| | |
|---|---|
| ***B41J 11/44*** | (2006.01) |
| ***B41J 11/02*** | (2006.01) |
| ***B41J 3/44*** | (2006.01) |

(52) U.S. Cl.
CPC ... *B41J 11/02* (2013.01); *B41J 3/44* (2013.01)

(58) Field of Classification Search
CPC ..... B41J 3/44; B41J 11/02
USPC ..... 400/76
See application file for complete search history.

(56) References Cited

U.S. PATENT DOCUMENTS

| | | | |
|---|---|---|---|
| 2,812,501 | A | 11/1957 | Sommers |
| 4,509,039 | A | 4/1985 | Dowdle |
| 5,192,954 | A | 3/1993 | Brockelsby et al. |
| 5,587,578 | A | 12/1996 | Serra |
| 5,777,586 | A | 7/1998 | Luxon et al. |
| 5,838,253 | A | 11/1998 | Wurz et al. |
| 6,099,178 | A | 8/2000 | Spurr et al. |
| 6,104,291 | A | 8/2000 | Beauvillier et al. |
| 6,123,024 | A | 9/2000 | Williams et al. |
| 6,150,809 | A | 11/2000 | Tiernan et al. |
| 6,166,637 | A | 12/2000 | Cyr et al. |
| 6,227,643 | B1 | 5/2001 | Purcell et al. |
| 6,246,326 | B1 | 6/2001 | Wiklof et al. |
| 6,267,521 | B1 | 7/2001 | Lodwig et al. |
| 6,327,972 | B2 | 12/2001 | Heredia et al. |
| 6,392,544 | B1 | 5/2002 | Collins et al. |
| 6,409,401 | B1 | 6/2002 | Petteruti et al. |

(Continued)

FOREIGN PATENT DOCUMENTS

| | | | |
|---|---|---|---|
| FR | 2 822 594 | | 9/2002 |
| JP | 2004362170 | A * | 12/2004 |

OTHER PUBLICATIONS

Machine Translation of JP2004-362170.*

(Continued)

*Primary Examiner* — Matthew G Marini

(57) ABSTRACT

Provided is an apparatus, such as a printer, that includes a media modification component, such as a printhead, and an opposing member, such as a platen. The opposing member opposes the media modification component and is configured to manipulate media for modification by the media modification component. An RFID interrogator including an electromagnetic coupler, such as an antenna, can be associated with the opposing member, for example, by disposing the electromagnetic coupler within a bore defined by the opposing member. In some embodiments, the interrogator and the media modification component can be in communication with a control system that can be configured to correlate a media modification operation of the media modification component with either or both of a signal emitted by or received by the electromagnetic coupler.

30 Claims, 8 Drawing Sheets

(56) References Cited

U.S. PATENT DOCUMENTS

| | | | | |
|---|---|---|---|---|
| 6,425,663 | B1 | 7/2002 | Eastlund et al. | |
| 6,512,594 | B1 | 1/2003 | Lenz et al. | |
| 6,527,356 | B1 | 3/2003 | Spurr et al. | |
| 6,565,188 | B1 | 5/2003 | Saito | |
| 6,585,345 | B2 | 7/2003 | Kosugi | |
| 6,593,853 | B1 | 7/2003 | Barrett et al. | |
| 6,644,544 | B1 | 11/2003 | Sanger et al. | |
| 6,793,301 | B2 | 9/2004 | Kaburagi | |
| 6,802,659 | B2 | 10/2004 | Cremon et al. | |
| 6,832,866 | B2 | 12/2004 | Klinefelter et al. | |
| 6,848,616 | B2 | 2/2005 | Tsirline et al. | |
| 6,857,714 | B2 | 2/2005 | Hohberger et al. | |
| 6,938,976 | B2 | 9/2005 | Siwinski et al. | |
| 6,943,678 | B2 | 9/2005 | Muirhead | |
| 6,967,579 | B1 | 11/2005 | Elizondo | |
| 6,969,134 | B2 | 11/2005 | Hohberger et al. | |
| 7,059,248 | B2 | 6/2006 | Vaidyanathan et al. | |
| 7,077,489 | B2 | 7/2006 | Waters | |
| 7,128,408 | B2 | 10/2006 | Kosugi | |
| 7,133,055 | B2 | 11/2006 | Vaidyanathan et al. | |
| 7,212,123 | B2 | 5/2007 | Waters et al. | |
| 7,342,499 | B2 | 3/2008 | Chiu et al. | |
| 7,398,054 | B2 * | 7/2008 | Tsirline et al. | 455/41.1 |
| 2001/0024160 | A1 | 9/2001 | Banach et al. | |
| 2002/0044164 | A1 | 4/2002 | Kaburagi | |
| 2002/0101498 | A1 | 8/2002 | Vuong et al. | |
| 2002/0191998 | A1 | 12/2002 | Cremon et al. | |
| 2003/0023337 | A1 | 1/2003 | Godfrey et al. | |
| 2003/0059050 | A1 | 3/2003 | Hohberger et al. | |
| 2003/0062131 | A1 | 4/2003 | Hohberger et al. | |
| 2003/0063001 | A1 | 4/2003 | Hohberger et al. | |
| 2003/0063139 | A1 | 4/2003 | Hohberger et al. | |
| 2003/0067504 | A1 | 4/2003 | Spurr et al. | |
| 2003/0076520 | A1 | 4/2003 | Haines et al. | |
| 2003/0160839 | A1 | 8/2003 | Kosugi | |
| 2004/0002305 | A1 | 1/2004 | Byman-Kevivuori et al. | |
| 2004/0061649 | A1 | 4/2004 | Wielsma | |
| 2004/0102870 | A1 | 5/2004 | Andersen et al. | |
| 2004/0178267 | A1 | 9/2004 | Tsirline et al. | |
| 2005/0021172 | A1 | 1/2005 | Winter et al. | |
| 2005/0024393 | A1 | 2/2005 | Kondo et al. | |
| 2005/0025553 | A1 | 2/2005 | Hohberger et al. | |
| 2005/0045723 | A1 | 3/2005 | Tsirline et al. | |
| 2005/0045724 | A1 | 3/2005 | Tsirline et al. | |
| 2005/0280537 | A1 | 12/2005 | Feltz et al. | |
| 2006/0019135 | A1 | 1/2006 | Curello et al. | |
| 2006/0066441 | A1 | 3/2006 | Knadle, Jr. et al. | |
| 2006/0191022 | A1 | 8/2006 | Hohberger et al. | |
| 2006/0221363 | A1 | 10/2006 | Roth et al. | |
| 2006/0238600 | A1 | 10/2006 | Vandermeulen et al. | |
| 2006/0255945 | A1 | 11/2006 | Egbert | |
| 2007/0013520 | A1 * | 1/2007 | Conwell et al. | 340/572.1 |
| 2007/0063843 | A1 | 3/2007 | Tsirline et al. | |
| 2007/0099566 | A1 | 5/2007 | Borisov et al. | |
| 2007/0147938 | A1 | 6/2007 | Brown et al. | |

OTHER PUBLICATIONS

Ron Schmitt; *Understanding electromagnetic fields and antenna radiation takes (almost) no math*EDN; Mar. 2, 2000; pp. 77-88; available at <http://www.ednmag.com>.

David M. Pozar; *Paragraph 2.5—The Quarter-Wave Transformer*; Microwave Engineering; 2005; pp. 73-76; Third Edition; John Wiley & Sons, Inc.

Constantine A. Balanis; *Chapter 2—Fundamental Parameters of Antennas: Paragraph 2.2.4—Field Regions*; Antenna Theory: Analysis and Design; 2005; pp. 34-36; Third Edition; John Wiley & Sons, Inc.

Xianming Qing and Ning Yang; *2.45 GHz Circularly Polarized RFID Reader Antenna*; IEEE; 2004; pp. 612-615 (XP10743394).

Boris Y. Tsirline; *UHF RFID Antennas for Printer-Encoders—Part I: System Requirements*; High Frequency Electronics; Sep. 2007; pp. 28-39 (8 pgs.); Summit Technical Media, LLC.

Boris Y. Tsirline; *UHF RFID Antennas for Printer-Encoders—Part 2: Antenna Types*; High Frequency Electronics; Oct. 2007; pp. 36-45 (8 pgs.); Summit Technical Media, LLC.

Boris Y. Tsirline; *UHF RFID Antennas for Printer-Encoders—Part 3: Mobile Equipment*; High Frequency Electronics; Nov. 2007; pp. 18-25 (5 pgs.); Summit Technical Media, LLC.

International Search Report from corresponding International Application No. PCT/US2008/065035.

International Search Report from corresponding International Application No. PCT/US2008/064883.

* cited by examiner

PLATEN INCORPORATING AN RFID COUPLING DEVICE

BACKGROUND

1. Field of the Invention

Embodiments of the present invention relate to printers and, more particularly, to printers including platens that incorporate electromagnetic couplers for coupling to radio frequency identification transponders.

2. Background Information

Radio frequency identification (RFID) transponders or tags, either active or passive, are typically used with an RFID interrogator or similar device for communicating information back and forth. In operation, the interrogator exposes the transponder to a radio frequency (RF) electromagnetic field or signal. In the case of a passive ultrahigh frequency (UHF) transponder, the RF electromagnetic field energizes the transponder and thereby prompts the transponder to respond to the transceiver by re-radiating the received signal back and modulating the field in a well-known technique called "backscattering." In the case of a passive high frequency (HF) transponder, the transponder modulates the impedance of an antenna to which it is magnetically coupled in order to send data back to an interrogator. In the case of an active transponder, the transponder may respond to the electromagnetic field by transmitting an independently generated and powered reply signal to the transceiver.

Problems can occur when interrogating multiple adjacent transponders, regardless of whether the transponders are powered by an on-board direct current (DC) power supply or by a RF field generated by a separate RFID interrogator. For example, an interrogating electromagnetic signal may activate more than one transponder at a given time. This simultaneous activation of multiple transponders may lead to communication (i.e., read and write) errors because each of the multiple transponders may attempt communication with the transceiver at the same time. Such communication interferences are known as "collisions."

Several collision management techniques commercially exist for allowing near simultaneous communication of a single interrogator with multiple transponders while reducing communication errors. However, such collision management techniques tend to increase system complexity and cost, and may also result in delayed response. Furthermore, such techniques are often "blind" in that they cannot locate a given transponder or more specifically recognize the position of a transponder within the interrogating RF electromagnetic field.

Another method of preventing the activation of multiple transponders is to electromagnetically isolate transponders from one another. For example, devices or systems may employ an RF-shielded housing or anechoic chamber for shielding the adjacent and non-targeted transponders from the electromagnetic field. In various applications, transponders individually pass though a shielded housing for individualized exposure to an interrogating RF electromagnetic field. Unfortunately, RF-shielded housings add cost and complexity to a system and limit the type (e.g., size) of transponders that can be processed by the system. Furthermore, many systems in which RFID tag interrogation might be employed are limited with regard to space or weight and, thus, cannot accommodate such shielded housings.

The challenge of avoiding multiple transponder activation may be especially acute in the case of RFID printer-encoders. RFID printer-encoders are devices capable of encoding and printing on a series or stream of labels having respective embedded transponders. The close proximity of the transponders to each other during processing makes targeting a particular transponder for encoding purposes problematic. Moreover, the space, cost, and weight restrictions associated with such devices, among other factors, make collision management techniques or shielding components for alleviating multiple transponder activation less than desirable. Further, "blind" collisions management techniques could lead to uncorrelated printing and data encoding for a given RF label.

In light of the foregoing it would be desirable to provide a RFID system or device capable of interrogating individual transponders positioned among multiple adjacent transponders without the need for collision management techniques or shielding components. It would be further desirable for such a RFID system to designate, with some degree of certainty, a specific transponder to be interrogated among multiple adjacent transponders, and to be capable of encoding a transponder positioned at or very close to a printline.

BRIEF SUMMARY

In one aspect, a media processing apparatus is provided that includes a media processing component, such as a printhead, and an opposing member configured to manipulate media for processing by the media processing component. The opposing member can be, for example, a nip roller, a platen, or other conveyance system adapted to position the media within the media processing apparatus. In some embodiments, the opposing member is positioned opposite to the media processing component. The opposing member and the media processing component may define a processing area between their relative positions. In some embodiments, the processing area includes not only the exact location at which processing may take place, but also some finite area surrounding the exact processing location. In other cases, the processing area may be confined to the exact location at which processing is taking place, which in the case where the media processing component is a printhead may be a single printline.

In various embodiments of the invention, an RFID coupling device, such as an interrogator, is associated with the opposing member. The interrogator includes an electromagnetic coupler, such as an antenna, and a transceiver or "reader." Generally, an electromagnetic coupler refers to a component or set of components configured to effectively transmit and/or receive electromagnetic waves and/or interact with electric currents or magnetic fields to allow the transfer of data (couplers executing these latter two functions might be terms "electric couplers" and "magnetic couplers," respectively). Such components may be formed of conductive materials, dielectrics, and/or magnetic materials, depending on the application. The transceiver can include components for generating electromagnetic waves emitted from the electromagnetic coupler and/or components for processing signals received from the electromagnetic coupler following the interaction of the electromagnetic coupler with an electromagnetic wave.

Also, for the purposes of this disclosure, "RF coupling" is defined as a means of contactless energy exchange between two (or more) RF devices/circuits being magnetically, electrically, or electromagnetically linked in their mutual reactive or/and radiating near-fields. An "RF electric, magnetic, or electromagnetic coupler" is understood to be an RF device/circuit that, when supplied by RF electric energy, causes RF near-field energy to be generated in the external field-generating devices/circuits, and/or when placed in a near-field associated with external field-generating devices/circuits, converts this RF field energy to an RF electric energy. An "RFID electric, magnetic, or electromagnetic coupler" is defined as an RF device/circuit that provides a (typically) bi-directional energy exchange between an RFID transceiver (i.e., a "reader") and RFID transponders in close proximity to each other (i.e., positioned so as to facilitate "near-field communications).

The media apparatus may be configured to communicate with a plurality of communication elements, such as RFID tags, transponders, inlays, and the like, that are included in/on or otherwise associated with media being manipulated by the opposing member. In such embodiments, the interrogator may be structured or configured for communicating with communication elements disposed in the processing area while avoiding communication with communication elements disposed outside the processing area.

In some embodiments, the interrogator and the media processing component can be in communication with a control system that is configured to correlate a media processing operation of the media processing component with a signal emitted by and/or received by the electromagnetic coupler. In another embodiment, the processing area may be substantially coincident with a communication area established at least in part by the interrogator. The communication area refers to the area within which the interrogator can effectively communicate with other devices (i.e., can effectively transmit signals to devices located within the communication area and/or can effectively receive signals from devices located within the communication area). The dimensions of the communication area may be affected by aspects of the interrogator, such as the structure and geometry of the electromagnetic coupler and the amount of power supplied thereto, and also by aspects of the respective communication element with which the interrogator is communicating (e.g., the size, shape, structure, orientation with respect to the interrogator, etc.) and aspects of the surrounding environment. Overall, the dimensions of the communication area will depend on the specific communication taking place between the interrogator and a respective communication element (a "communication event"), and may change from one communication event to another. The control system may, in some cases, be at least partially integrated with or otherwise include the functionality of the interrogator.

In another aspect, a printer is provided that includes a printhead and an opposing platen. The platen and printhead together can define a print area therebetween for receiving media for printing by the printhead. An interrogator, including a transceiver and an electromagnetic coupler, can be associated with the platen. The electromagnetic coupler can be, for example, an edge-firing planar stripline antenna (e.g., for communications in the ultra-high frequency (UHF) band) or an edge-coupling magnetic antenna (e.g., for communications in the high frequency (HF) band). In some embodiments, the interrogator can be coupled to the platen so as to cause the electromagnetic coupler to be perpendicular to media disposed for printing by the printhead. The media can include a plurality of communication elements and the interrogator can be configured to communicate with communication elements disposed in the print area while avoiding communication with communication elements disposed outside the print area. The platen can be at least partially formed of a material that is substantially transparent to electromagnetic radiation and/or magnetic waves with frequencies in the radio wave spectrum.

In yet another aspect, a printer is provided that includes a printhead and a conveyance system for manipulating media. The conveyance system can include a nip roller disposed opposite the printhead, such that the nip roller and printhead together define a print area therebetween for receiving media for printing by the printhead. An interrogator can be associated with the nip roller and can be configured to communicate with one or more of a plurality of communication elements included in the media and disposed in the print area while avoiding communication with one or more of the communication elements included in the media and disposed outside the print area.

In still another aspect, a platen for a printer is provided. The platen includes a platen body configured to be disposed opposite a printhead so as to define, with the printhead, a print area for receiving media for printing by the printhead. An interrogator can be associated with the platen body and configured to communicate with one or more communication elements disposed in the print area while avoiding communication with one or more communication elements disposed outside the print area. In some embodiments, the platen body can define a bore and the electromagnetic coupler can be disposed within the bore.

In yet another aspect, a method for processing media is provided that includes manipulating media into a processing area of a media processing apparatus, such that a portion of the media having a communication element is disposed for processing by the media processing apparatus. While the media is in the processing area, communications are undertaken with the communication element and the portion is processed with the media processing apparatus. In some embodiments, the media is manipulated out of the processing area after processing the portion with the media processing apparatus, and a distinct body of media is retrieved for processing by the media processing apparatus. In other embodiments, the communicating with the communication element includes at least one of receiving or transmitting a signal, and a processing operation of the media processing apparatus can be correlated with at least one of the transmitted or received signal. In still other embodiments, the communicating with the communication element includes interrogating a communication element; and the processing the portion with the media processing apparatus includes printing on the portion.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 10B:
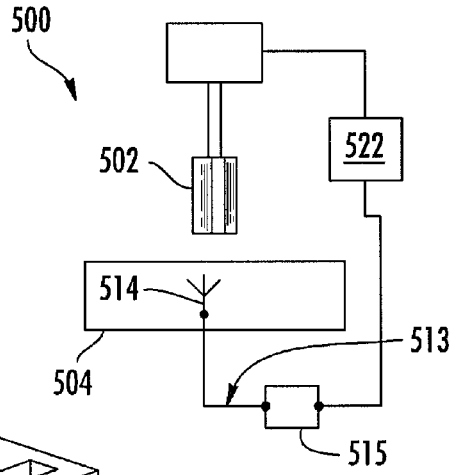
Figure 10A:
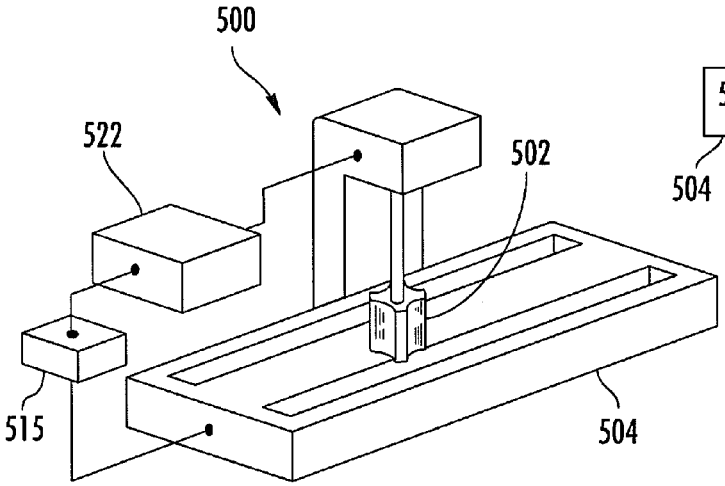
Figure 11A:
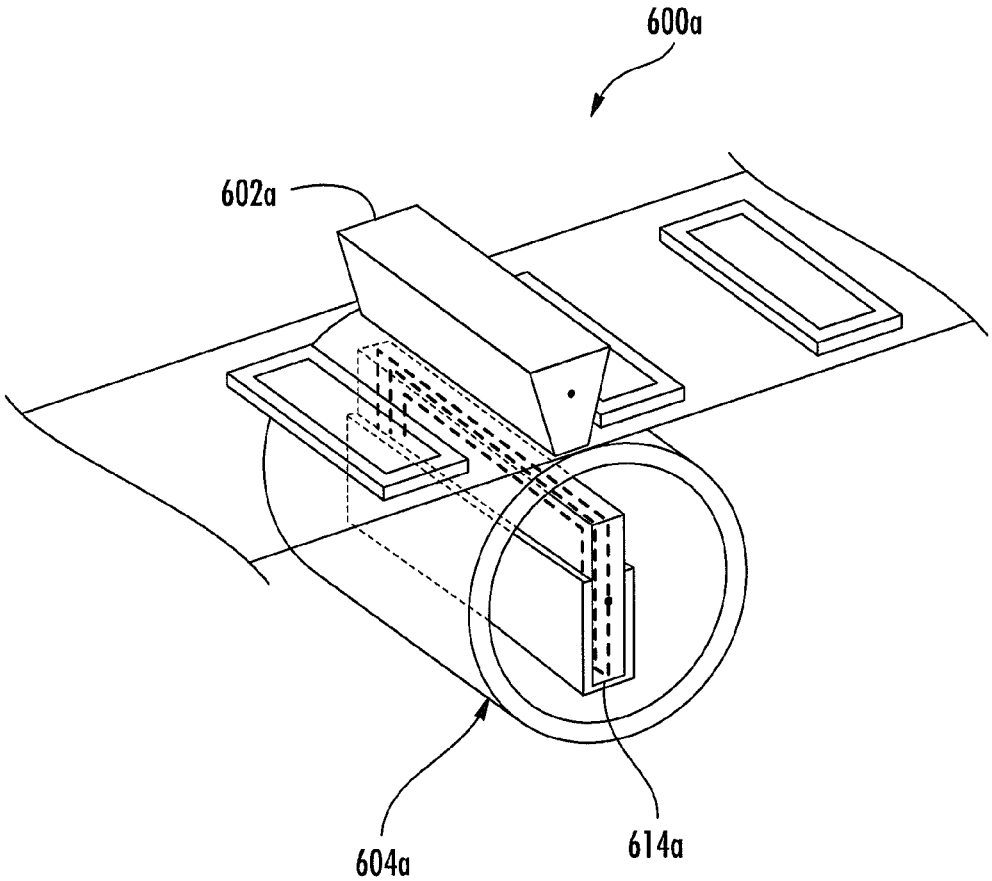
Figure 11B:
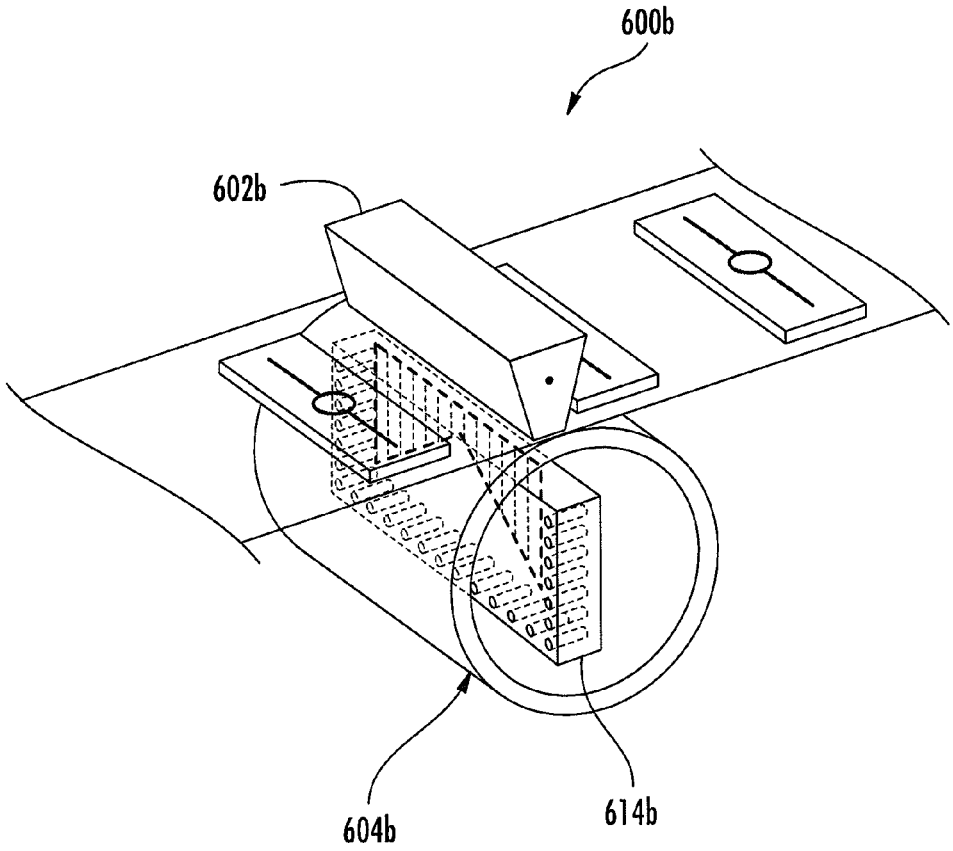

FIGS. 10A and 10B are partial schematic perspective and side views of a milling machine configured in accordance with another exemplary embodiment, the milling machine including an electromagnetic coupler; and FIGS. 11A and 11B are partial schematic perspective views of printers configured to operate in accordance with exemplary embodiments, the printers including electromagnetic couplers configured for HF and UHF communications environments, respectively.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
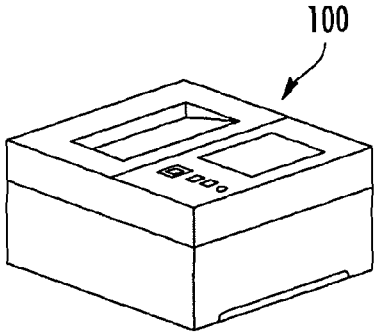
FIGS. 1A and 1B are schematic perspective views of a printer with the printhead in closed and open positions, respectively, the printer being configured in accordance with an exemplary embodiment.
Figure 1B:
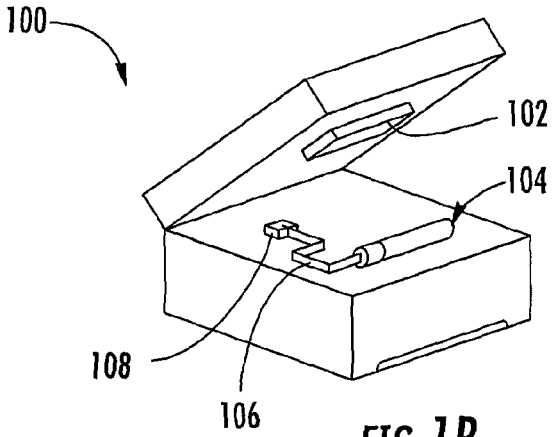
Figure 3A:
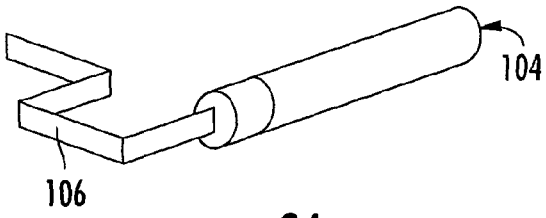
FIGS. 3A and 3B are schematic perspective and exploded views, respectively, of the platen of FIG. 2, showing the interrogator associated with the platen.
Figure 3B:
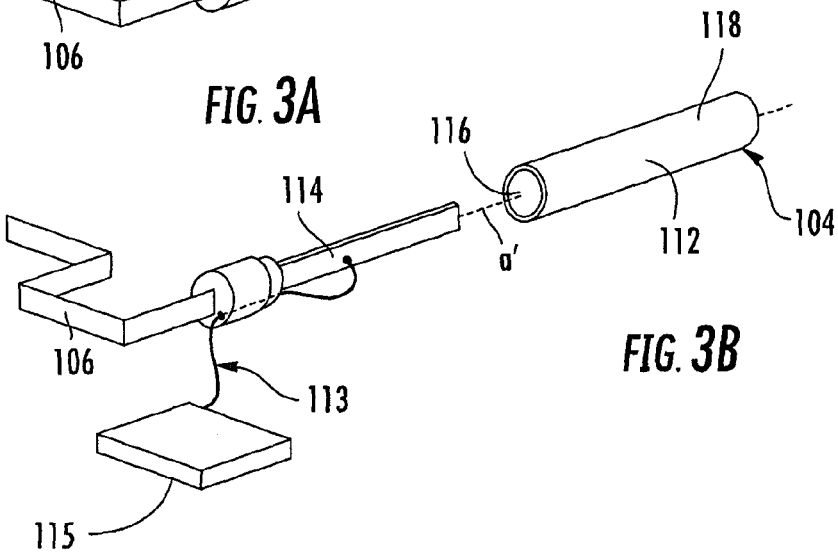

Referring to FIGS. 1A and 1B, therein are shown views of a media processing apparatus configured in accordance with an exemplary embodiment. In this case, the depicted media processing apparatus is a printer 100, although in other embodiments, the media processing apparatus may be any device capable of receiving and processing/modifying media, including, for example, a copier, a label machine, a fax machine, a drill, milling machine, lathe, or some other cutting or engraving device, an automatic painting machine, a stamp or press, a printer-encoder, and the like. The media processing apparatus may also include any of a variety of printers, including card printers, label printers, ticket printers, baggage claim tag printers, and wristband printers. Generally, for the purposes of this disclosure, the term "media" includes any entity or set of entities that is capable of carrying information, such as, for example, paper, cards, labels, ribbons, intermediate transfer media, etc. The printer 100 includes a media processing component, which in the depicted embodiment includes a printhead 102. In other embodiments, the media processing component may include, for example, a transfer roller, a spray nozzle, a tear bar, a stamp head, a drill bit, etc.

An opposing member, which in the depicted embodiment is a driven or roller platen 104, is positioned so as to oppose the printhead 102. Generally, for the purposes of this disclosure, the term "opposing member" includes any body that is capable of supporting media, such as, for example, a platen, a nip roller, a conveyance system, etc. The opposing member 104 and media processing component 102 can define a processing area p therebetween (FIG. 5A), which is discussed further below. The platen 104 may be supported by a support arm 106 that locates the platen with respect to a chassis 108 of the printer 100.

Figure 2:
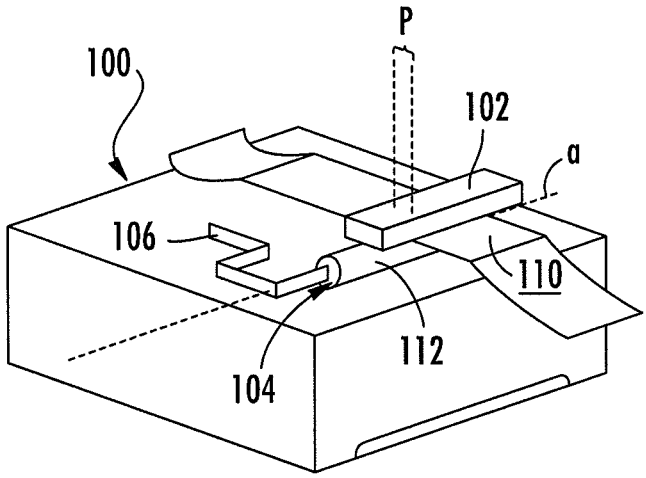
FIG. 2 is a schematic partial perspective view of the printer of FIGS. 1A and 1B, the printer retaining and manipulating print media between an associated printhead and platen.

Referring to FIG. 2, the platen 104 can be configured to retain and/or manipulate media for processing (e.g., printing) by the printhead 102. Specifically, the platen 104 may be configured to manipulate the print media, in the illustrated case labels 110, to translate relative to the printhead 102 and move into a processing position p (i.e., the position in which media may be processed by the media processing apparatus), in order to allow processing of the media (or a portion thereof) through a media processing operation (i.e., in this case, a printing operation). For example, the platen 104 may be cylindrical and may include a surface 112 having a high coefficient of friction, perhaps formed from silicone rubber, that supports the labels 110 and rotates around an axis a. A drive mechanism (not shown), such as a motor or other actuator, can be included in the printer 100 so as to drive rotation of the platen 104 about the axis a and thereby move the print media relative to the printhead 102. The processing area p will tend to depend on the structure of the printhead 102, and in some cases will be limited to a single elongated area of high aspect ratio called the "print line."

Referring to FIGS. 2, 3A, 3B, and 4, an interrogator 113 can be associated with the platen 104. The interrogator 113 can include an electromagnetic coupler 114, such as an antenna, and a transceiver 115. The interrogator 113 can be associated with the platen 104, for example, by integrating the electromagnetic coupler 114 (and, perhaps, the transceiver 115) with the platen, by disposing the electromagnetic coupler within the platen, by attaching the electromagnetic coupler to the platen, etc. In one embodiment, the platen 104 can define a bore 116 within which the electromagnetic coupler 114 is disposed. In some embodiments, the platen 104 may include an elongated portion, such as a cylindrical portion 118, that defines an axis a', and the bore 116 may extend along the axis a'. It is noted that, generally, the electromagnetic coupler 114 can be placed in relatively close proximity to the media 110 being printed on by the printhead 102.

In some embodiments, in order to limit the extent to which the platen 104 may interfere of with the ability of the electromagnetic coupler 114 to emit or receive electromagnetic signals and thereby facilitate the interaction of the electromagnetic coupler with specific types of electromagnetic radiation, the platen 104 may be at least partially formed of a material that is substantially transparent to electromagnetic radiation and/or magnetic waves in a targeted part of the electromagnetic spectrum. For example, in the case where the targeted radiation/magnetic waves are radio waves, the platen 104 can be formed of glass or polypropylene material. In other embodiments, the platen 104 may be comprised of metal, polymers, dielectrics, and/or semiconductors.

Figure 5A:
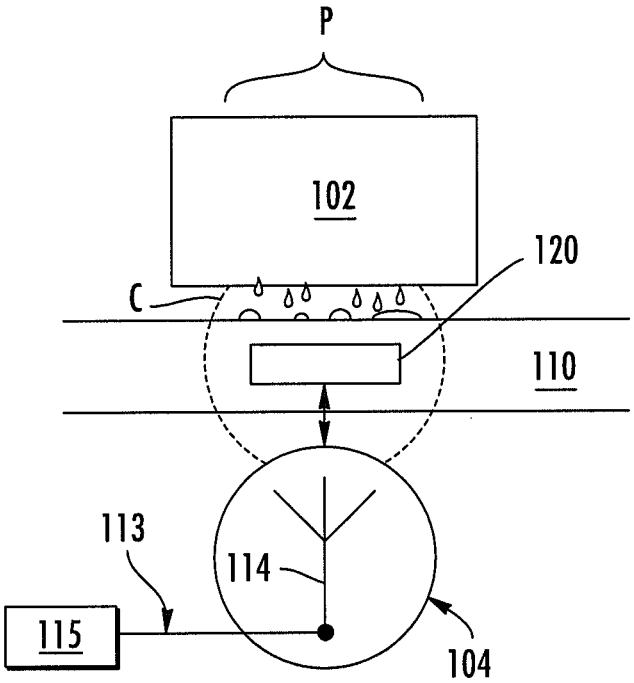
FIGS. 5A and 5B are magnified schematic side views of a printhead, platen, and print media therebetween, an interrogator being associated with the platen and the print media including one or more communication elements.
Figure 4:
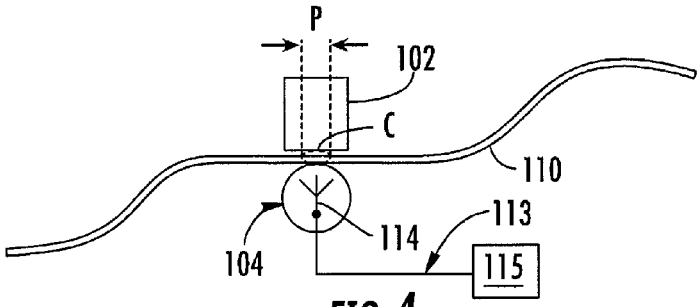
FIG. 4 is a schematic side view of the printhead, platen, and print media of FIG. 2.
Figure 5B:
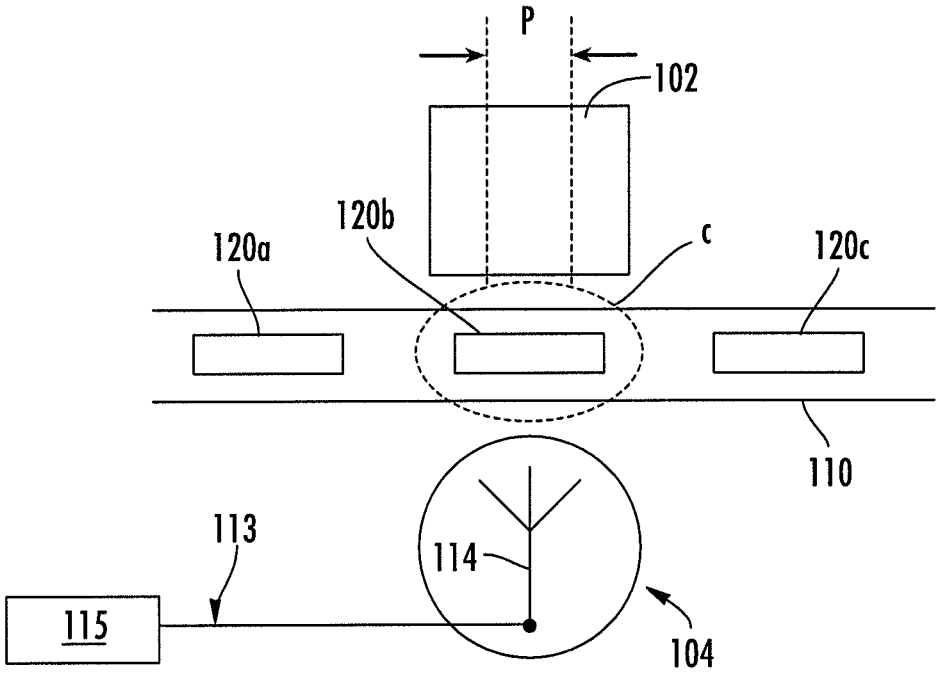

Referring to FIGS. 4 and 5A-B, by associating the interrogator 113 with the platen 104, some embodiments may allow for the electromagnetic coupler 114 to interact with communication elements 120, such as those that may be located in/on or otherwise associated with a portion of the media 110. Generally, for the purposes of this disclosure, the term "communication element" includes any electromagnetic radiation-emitting, radiation-detecting, and/or radiation-activated device, such as, for example, radio frequency identification (RFID) transponders or tags, electronic article surveillance tags, microwave tags, inlays, etc. The interrogator 113 may at least in part define a communication area c, the spatial extent of which will, as discussed above, depend on a variety of factors and vary from one communication event to another.

As mentioned above, the opposing member or platen 104 and media processing component or printhead 102 can define a processing area p therebetween. In some cases, the media 110 may include a plurality of communication elements 120*a-c*. The interrogator 113 can be configured to communicate, via the electromagnetic coupler 114, with communication element 120*b* disposed within the processing area p, while at the same time avoiding communication with communication elements 120*a*, 120*c* disposed outside of the processing area p. That is, the electromagnetic coupler 114 and transceiver 115 can be configured (by taking all of the appropriate factors into consideration) such that the associated communication area c may substantially coincide with the processing area p. It is noted that, in cases where the communication area c is substantially coincident with the processing area p, communication could readily occur with communication elements contained in a portion of media that is being processed. Further, in some embodiments, communication between the interrogator 113 and the communication elements 120 associated with a portion of media may occur substantially simultaneously with processing (e.g., printing, etc.) of the same portion of media.

It is noted that some embodiments may allow for individual communication with and/or encoding of communication elements that are provided serially and with a relatively small pitch. This may be true even in extreme cases where adjacent communication elements have a pitch roughly equal to the dimensions of the communication elements, as, for example, where the communication elements are RFID transponders situated in respective labels provided in a strip and having dimensions equal to transponders dimensions and are following one after another (a situation referred to as "Print on Pitch"). As such, some embodiments may enable sequential printing and encoding the RFID tags associated with adjacent labels without additional spacing requirements, shielding requirements, and/or collision management techniques, thereby potential enabling the utilization of labels with the shortest possible dimensions relative to the transponders contained therein.

The electromagnetic coupler 114 may include an edge-coupling magnetic antenna and/or an edge-firing planar stripline antenna, and may be configured so as to be perpendicular to the media (e.g., the labels 110) on which the printhead 102 is printing. An example of an edge-firing planar stripline antenna that may be incorporated into the platen 104 is that disclosed in U.S. patent application Ser. No. 11/371,785 filed Mar. 9, 2006 and assigned to the assignee of the present application, the contents of which are hereby incorporated by reference in their entirety. Other antennas configured for near field communication may be used in accordance with various embodiments of the present invention. For example, antennas of the type described in the following commonly owned patent applications may be used: U.S. patent application Ser. No. 10/604,996 filed Aug. 29, 2003; U.S. patent application Ser. No. 11/231,391 filed Sep. 9, 2005; U.S. patent application Ser. No. 11/694,329 filed Mar. 30, 2007; and U.S. patent application Ser. No. 11/829,455 filed Jul. 27, 2007. Each of the above listed patent applications are hereby incorporated by reference in their entirety.

Figure 6:
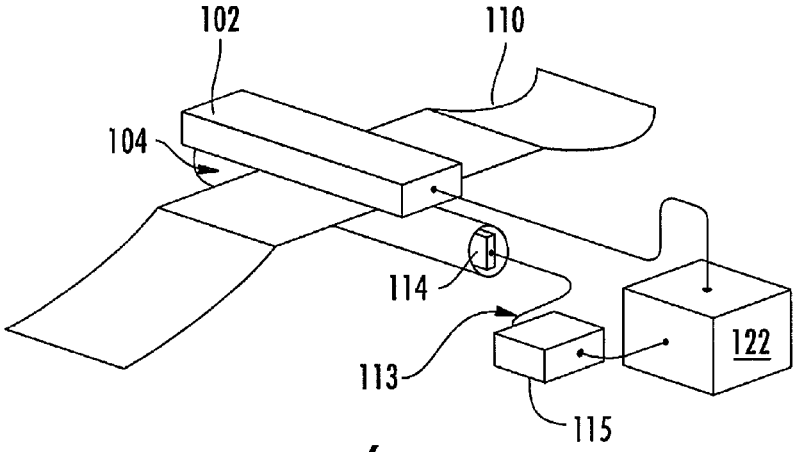
FIG. 6 is a schematic perspective view of a printhead, a platen, and an interrogator, the interrogator being in communication with a control system and the printhead being connected to the control system.

Referring to FIG. 6, the interrogator 113 may be in communication with a control system 122 that is coupled to the printhead 102. The control system 122 may include, for example, one or more general purpose computers and/or dedicated circuits or sets of components, such as a printed circuit board (e.g., the main logic board or "MLB") and/or data acquisition devices. In some embodiments, the control system 122 may include the functionality of the transceiver associated with the interrogator 113. The control system 122 may serve to correlate a printing operation of the printhead 102 with either or both of a signal emitted by the electromagnetic coupler 114 or a signal received by the electromagnetic coupler. That is, the electromagnetic coupler 114 and control system 122 can be configured to collectively act as, among other things, an interrogator. Further, in light of the relatively close spatial proximity between the electromagnetic coupler 114 and the printhead 102 that may exist in some embodiments, in cases where the media 110 includes or is associated with one or more communication elements, the control system 122 may direct that communication between the interrogator 113 and the respective communication elements be consistent with the processing (e.g., printing, etc.) operation being performed on the media. This function of the control system 122 is described further below by way of example.

Figure 7A:
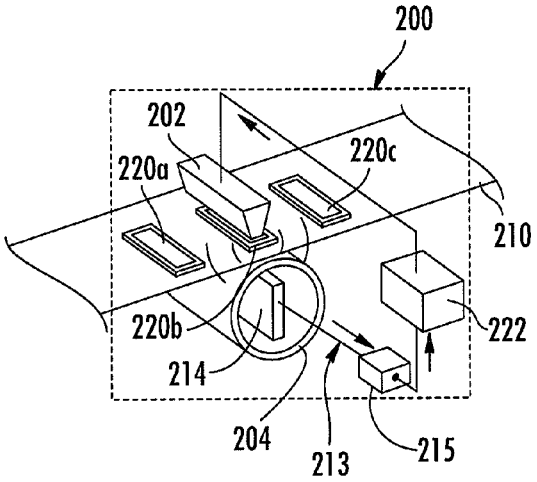
FIGS. 7A and 7B are block diagrams schematically representing the operation of a printer configured in accordance with an exemplary embodiment in which the interrogator performs receiving activity.
Figure 7B:
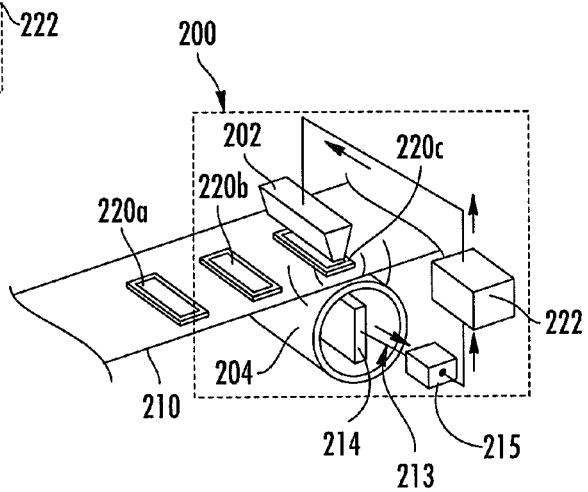

Referring to FIGS. 7A and 7B, therein is depicted a schematic representation of a printer 200 configured to operate in accordance with an exemplary embodiment. The printer 200 includes a printhead 202 and a platen 204 that is associated with an interrogator 213, in this case incorporating an electromagnetic coupler 214 of the interrogator. The printer 200 receives therein print media 210 that includes a series of communication elements, such as, for example, a series of RFID tags 220*a-c*. The print media 210 could be, for example, a continuous strip of material (e.g., paper, labels, items on a liner, etc.) that may subsequently be singulated (e.g., cut, torn, etc.) to form a plurality of media units (e.g., sheets, labels, etc.), which may each contain a RFID tag.

As noted above, RFID tags 220*a-c* carried by media structured in accordance with various embodiments of the invention may contain previously encoded information and/or may exchange information through communication with the interrogator 213. The interrogator 213 may be in communication with or integrated with a control system 222. The RFID tags 220*a-c* may be disposed within the media 210 as shown or, in alternate embodiments, may be affixed to or otherwise associated with the media.

During operation of the printer 200, the print media 210 may be translated relative to the printhead 202 by the platen 204. As the print media 210 is translated, each RFID tag 220*a-c* and corresponding portion of the print media respectively passes between the printhead 202 and the platen 204 (i.e., passes through the processing area or the position in which each respective print media portion may be printed to by the printhead) and through the communication area associated with the interrogator 213 and applicable to this specific communication event. When disposed in the communication area, a respective RFID tag is positioned for communication with the electromagnetic coupler 214 and any reader/encoder 215 associated therewith. For example, in FIG. 7A, the depicted RFID tag 220*b* passes between the printhead 202 and the platen 204 into the communication area (which is understood in this case to include the area between the printhead and the platen) where it is interrogated by the interrogator 213.

In some embodiments, data received by the interrogator 213 (via the electromagnetic coupler 214) from the communication elements (e.g., RFID tag 220*b*) may be transmitted to the control system 222 to inform various media processing operations, as exemplified below. In one embodiment, the control system 222 may be configured to control a printing operation of the printhead 202 based on, say, serial number data associated with a specific RFID tag. For example, the control system 222 may cause the printhead 202 to print the serial number (e.g., as alphanumeric text or a barcode) on the media portion containing RFID tag 220*b*, such that the media portion includes both a RFID tag capable of communicating an associated serial number (e.g., as radio frequency identifier) and a visual identifier of the serial number. Alternatively, the control system 222 may include logic sufficient to correlate other types of printing operations with data associated with one or more communication elements. For example, data may be stored to a communication element that causes the printer to print specific text (e.g., address information, company names, etc.) or images (e.g., label text and graphics of various size, shapes, etc.).

As operation of the printer 200 continues, the print media 210 is translated relative to the printhead 202 and platen 204 such that a different RFID tag, tag 220*c*, passes between the printhead 202 and platen 204 (e.g., as shown in FIG. 7B). The interrogator 213 can then act to read RFID tag 220*c* and report the content thereof to the control system 222. The control system 222 can then cause the printhead 202 to perform a printing operation that is specific to RFID tag 220*c*. In other embodiments, the control system could direct that information, which may or may not relate to the printed content, be encoded to the RFID tag as discussed in greater detail below.

Figure 8A:
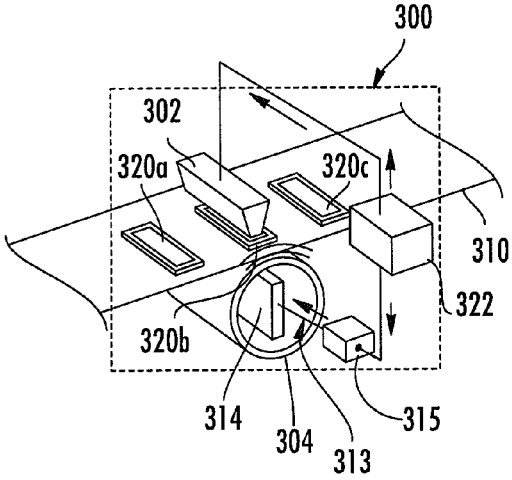
FIGS. 8A and 8B are block diagrams schematically representing the operation of a printer configured in accordance with another exemplary embodiment in which the interrogator performs transmitting activity.
Figure 8B:
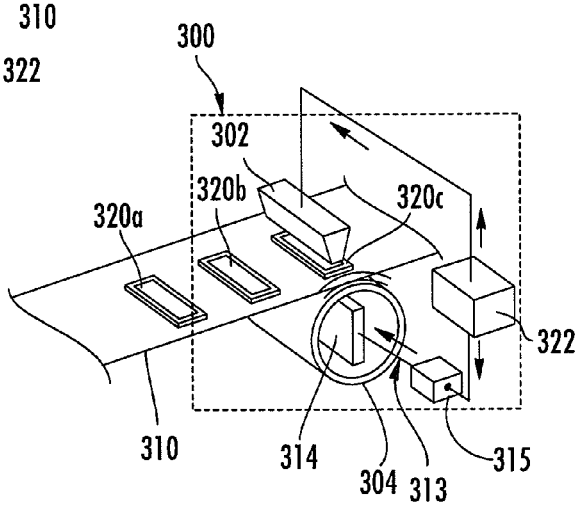

FIGS. 8A and 8B provide a schematic representation of a printer 300 configured to operate in accordance with an exemplary embodiment. The depicted printer 300 is configured to receive print media 310 that includes a series of RFID tags 320*a-c*. In the depicted embodiment, the RFID tags 320*a-c* have not been encoded prior to being received by the printer 300 (or may be encoded with information that will subsequently be replaced). At the point shown in FIG. 8A, the control system 322 sends control signals to the printhead 302 and information to the interrogator 313. Such control signals and/or information can be generated based on information contained within the control system 322 or from an external source, such as a network or a separate computer/component to which the control system may be connected. In response to receiving the control signals, the printhead 302 performs a printing operation on the print media portion incorporating the RFID tag 320*b*. In response to receiving the information from the control system 322, the reader 315, perhaps simultaneously with the printing operation, generates a signal that is transmitted via the electromagnetic coupler 314 and acts to encode RFID tag 320*b*. Subsequently, the print media 310 translates and the process is repeated for the RFID tag 320*c* (see FIG. 8B). Overall, the interrogator 313, possibly in conjunction with the control system 322, can act as a transmitter, as a receiver, and/or as a transceiver, both reading from and writing to RFID tags.

Figure 9A:
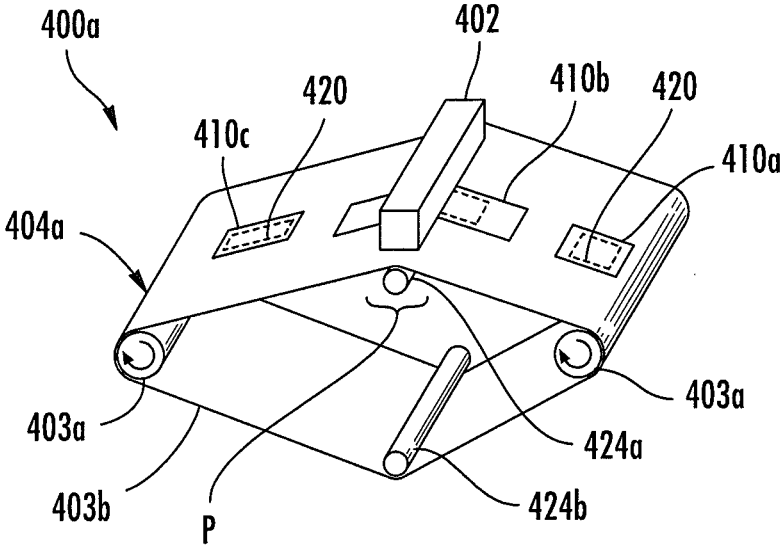
FIGS. 9A and 9B are partial schematic perspective views of media processing apparatuses configured in accordance with further exemplary embodiments and including variously arranged conveyance systems.
Figure 9B:
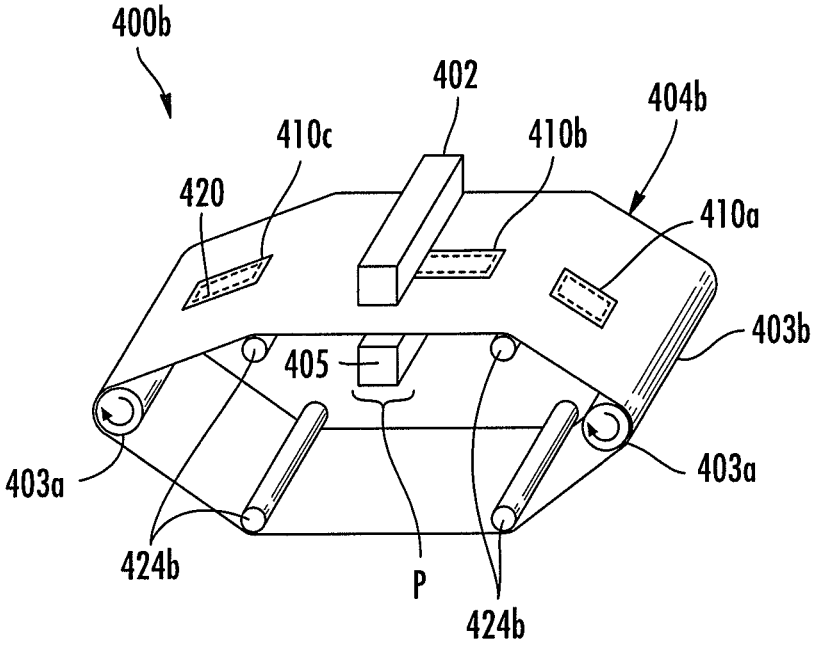

Referring to FIGS. 9A and 9B, therein are shown media processing apparatuses 400*a-b* each configured in accordance with another exemplary embodiment. Each of the apparatuses 400*a-b* includes a media processing component 402 and an opposing member in the form of a conveyance system 404*a-b* that includes a driven roller 403*a* and an associated belt 403*b*. In some embodiments, the conveyance system 404*a-b* may include one or more nip rollers 424*a-b*. While the apparatuses 400*a-b* are capable of handling a variety of forms of media, the media utilized in the illustrated embodiments consists of a series of distinct bodies or cards 410*a-c*. The cards 410*a-c* can be manipulated by the respective conveyance systems 404*a-b*, sequentially transporting each card into the processing area p associated with the media processing apparatuses 400*a-b*. For example, in the illustrated embodiments, a portion of card 410*b* occupies the processing area p, while card 410*a* has passed beyond the processing area p and card 410*c* has yet to reach the processing area p. As with previously discussed embodiments, the respective conveyance systems 404*a-b* may be associated with an antenna or other electromagnetic coupler (not shown) that facilitates communication with communication elements 420 associated with the cards 410*a-c*. For example, the electromagnetic coupler may couple to the nip roller 424*a*, to a separate part 405, or to a dedicated component included especially for housing the electromagnetic coupler.

Referring to FIGS. 10A and 10B, therein are shown views of a media modification apparatus configured in accordance with another exemplary embodiment. In this case, the media processing apparatus is a milling machine 500. The milling machine 500 includes a media processing component, which in this case includes a mill 502. An opposing member, in the illustrated case, a mill table 504, opposes the mill 502. The mill table 504 can be configured to retain and/or manipulate media, such as wood or plastic, for modification by the mill 502. An interrogator 513 including an electromagnetic coupler, such as antenna 514, and a transceiver 515, can be associated and/or integrated with the mill table 504 and in communication with a control system 522, which also controls the functioning of the mill 502 (including the movements of the mill table 504). For media containing one or more communication elements (not shown), the control system 522 may serve to correlate a milling operation of the mill with either or both of a signal emitted by the antenna 514 (e.g., where the communication element(s) are encoded in conjunction with the milling operation) or a signal received by the antenna (e.g., where the communication element(s) are encoded prior to the milling operation and the data encoded therein dictates aspects of the milling operation). In some embodiments, transponders may be included in raw portions of media that are encoded with data dictating subsequent forming, shaping, engraving, or other processing involving that raw media.

FIGS. 11A and 11B depict a schematic representation of portions of printers 600*a-b* configured to operate in accordance with an exemplary embodiment. A variety of different electromagnetic couplers may be respectively included in the printers 600*a-b*. For example, in FIG. 11A, the printer 600*a* includes an electromagnetic coupler 614*a* suited for HF communications environments, such as the electromagnetic coupler disclosed in U.S. Pat. No. 6,848,616, the contents of which are incorporated herein by reference in their entirety. In the illustrated embodiment, the electromagnetic coupler 614*a* has been incorporated into a hollow platen 604*a* of the printer 600*a*, the platen being located so as to oppose a printhead 602*a* of the printer. In FIG. 11B, the printer 600*b* includes an electromagnetic coupler 614*b* suited for UHF communications environments, such as the electromagnetic coupler disclosed in U.S. patent application Ser. No. 11/371,785 filed Mar. 9, 2006. In this case, the electromagnetic coupler 614*b* has again been incorporated into a hollow platen 604*b* of the printer 600*b*, the platen being located so as to oppose a printhead 602*b* of the printer.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A media processing apparatus comprising:

a media processing component;

an opposing member disposed opposite said media processing component and configured to manipulate media for processing by said media processing component, said opposing member and said media processing component defining a processing area therebetween; and an interrogator disposed opposite said media processing component, said interrogator including an electromagnetic coupler, wherein the media comprises a plurality of communication elements and said interrogator is configured to communicate with one or more of the plurality of communication elements disposed in the processing area while avoiding communication with one or more of the plurality of communication elements disposed outside the processing area.

2. The media processing apparatus according to claim 1, wherein said media processing component includes a printhead.

3. The media processing apparatus according to claim 1, wherein said opposing member includes a nip roller.

4. The media processing apparatus according to claim 1, wherein said opposing member includes a platen adapted to position the media within said media processing apparatus.

5. The media processing apparatus according to claim 1, wherein said opposing member includes a conveyance system adapted to position the media within said media processing apparatus.

6. The media processing apparatus according to claim 1, wherein said interrogator and said media processing component are in communication with a control system that is configured to correlate a media processing operation of said media processing component with at least one of a signal emitted by or received by said electromagnetic coupler.

7. The media processing apparatus according to claim 1, wherein the processing area is substantially coincident with a communication area established at least in part by said interrogator.

8. A printer comprising:

a printhead;

a platen disposed opposite said printhead, said platen and said printhead defining a print area therebetween for receiving media for printing by said printhead; and an interrogator disposed opposite said printhead, said interrogator including an electromagnetic coupler, wherein the media comprises a plurality of communication elements and said interrogator is configured to communicate with one or more of the plurality of communication elements disposed in the print area while avoiding communication with one or more of the plurality of communication elements disposed outside the print area.

9. A printer according to claim 8, wherein said electromagnetic coupler includes an edge-firing planar stripline antenna.

10. A printer according to claim 9, wherein said electromagnetic coupler is configured so as to be perpendicular to media disposed for printing by said printhead.

11. A printer according to claim 8, wherein said electromagnetic coupler includes an edge-coupling magnetic antenna.

12. A printer according to claim 11, wherein said electromagnetic coupler is configured so as to be perpendicular to media disposed for printing by said printhead.

13. A printer according to claim 8, wherein said platen is at least partially formed of a material that is substantially transparent to electromagnetic radiation and magnetic waves with frequencies in the radio wave spectrum.

14. A printer according to claim 8, wherein said interrogator is in communication with a control system, and said printhead is coupled to the control system, and wherein the control system is configured to correlate a printing operation of said printhead with at least one of a signal emitted by or received by said electromagnetic coupler.

15. A printer comprising:

a printhead;

a conveyance system for manipulating media, said conveyance system including a nip roller disposed opposite said printhead, said nip roller and said printhead defining a print area therebetween for receiving media for printing by said printhead; and an interrogator disposed opposite said printhead, said interrogator including an electromagnetic coupler, wherein the media comprises a plurality of communication elements and said interrogator is configured to communicate with one or more of the plurality of communication elements disposed in the print area while avoiding communication with one or more of the plurality of communication elements disposed outside the print area.

16. A printer according to claim 15, wherein said electromagnetic coupler includes an edge-firing planar stripline antenna.

17. A printer according to claim 16, wherein said electromagnetic coupler is configured so as to be perpendicular to media disposed for printing by said printhead.

18. A printer according to claim 15, wherein said electromagnetic coupler includes an edge-coupling magnetic antenna.

19. A printer according to claim 18, wherein said electromagnetic coupler is configured so as to be perpendicular to media disposed for printing by said printhead.

20. A printer according to claim 15, wherein said nip roller is at least partially formed of a material that is substantially transparent to electromagnetic radiation and magnetic waves with frequencies in the radio wave spectrum.

21. A printer according to claim 15, wherein said interrogator is in communication with a control system and said printhead is coupled to the control system, and wherein the control system is configured to correlate a printing operation of said printhead with at least one of a signal emitted by or received by said electromagnetic coupler.

22. A platen for a printer, said platen comprising:

a platen body configured to be disposed opposite a printhead so as to define, with the printhead, a print area for receiving media for printing by the printhead; and an interrogator disposed opposite said printhead, said interrogator including an electromagnetic coupler and being configured to communicate with one or more communication elements disposed in the print area while avoiding communication with one or more communication elements disposed outside the print area.

23. The platen of claim 22, wherein said platen body defines a bore and said electromagnetic coupler is disposed within the bore.

24. A platen according to claim 22, wherein said electromagnetic coupler includes an edge-firing planar stripline antenna.

25. A platen according to claim 22, wherein said electromagnetic coupler includes an edge-coupling magnetic antenna.

26. A platen according to claim 22, wherein said platen is at least partially formed of a material that is substantially transparent to electromagnetic radiation and magnetic waves with frequencies in the radio wave spectrum.

27. A method for processing media comprising:

manipulating media, using an opposing member, into a processing area of a media processing apparatus, the media processing apparatus disposed opposite the opposing member, such that a portion of the media is disposed for processing by the media processing apparatus, the portion having a communication element;

communicating with the communication element while the media is in the processing area, the communicating performed at least partially by an interrogator included in the opposing member disposed opposite the media processing apparatus; and processing the portion with the media processing apparatus while the media is in the processing area.

28. A method according to claim 27, further comprising:

manipulating the media out of the processing area after processing the portion with the media processing apparatus; and subsequent to said manipulating the media out of the processing position, manipulating a distinct body of media into the processing area.

29. A method according to claim 27, wherein said communicating with the communication element includes at least one of receiving or emitting a signal, said method further comprising correlating a processing operation of the media processing apparatus with at least one of the emitted or received signal.

30. A method according to claim 27, wherein said communicating with the communication element includes interrogating a communication element; and said processing the portion with the media processing apparatus includes printing on the portion.

* * * * *